US010105738B2

(12) United States Patent
Wiedemann

(10) Patent No.: US 10,105,738 B2
(45) Date of Patent: Oct. 23, 2018

(54) DEVICE FOR CLEANING AND/OR INSPECTION OF A FLOW CHANNEL

(71) Applicant: Karl Wiedemann, Welden (DE)

(72) Inventor: Karl Wiedemann, Welden (DE)

( * ) Notice: Subject to any disclaimer, the term of this patent is extended or adjusted under 35 U.S.C. 154(b) by 172 days.

(21) Appl. No.: 14/844,748

(22) Filed: Sep. 3, 2015

(65) Prior Publication Data

US 2016/0067751 A1 Mar. 10, 2016

(30) Foreign Application Priority Data

Sep. 4, 2014 (DE) ..... 10 2014 012 882

(51) Int. Cl.
*B08B 9/04* (2006.01)
*E03F 9/00* (2006.01)
*B08B 9/032* (2006.01)

(52) U.S. Cl.
CPC ..... *B08B 9/04* (2013.01); *B08B 9/0321* (2013.01); *E03F 9/00* (2013.01); *E03F 9/005* (2013.01)

(58) Field of Classification Search
CPC .. B08B 9/04; B08B 9/0321; E03F 9/00; E03F 9/005; F16L 27/00–27/125
See application file for complete search history.

(56) References Cited

U.S. PATENT DOCUMENTS 6,279,961 B1 * 8/2001 Stoltz ..... F16L 27/125 15/1.7

FOREIGN PATENT DOCUMENTS

DE 102011120152 6/2013
DE 202012011773 4/2014

* cited by examiner

*Primary Examiner* — Spencer E Bell
(74) *Attorney, Agent, or Firm* — Ewers & Hasselmann PLLC

(57) ABSTRACT

A device for cleaning and/or inspection of a flow channel is provided including a purge hose introduced into the flow channel, charged with high pressure purge water, and connected to a channel nozzle provided with jet nozzles creating a recoil effect. The channel nozzle is controllable by rotation around its axis. A simple, cost-effective, trouble-free construction and high precision can be accomplished by subdividing the purge hose into at least two sections which are connected with each other by a coupling unit through which high pressure purge water flows. The device has a housing element connected to a purge hose section and a hollow piston element arranged in the housing element in an axially movable manner and connected to another purge hose section. The housing element and the hollow piston element are supported by a spring and are cooperating via a converter converting an axial movement into a rotation.

14 Claims, 2 Drawing Sheets

DEVICE FOR CLEANING AND/OR INSPECTION OF A FLOW CHANNEL

CROSS REFERENCE TO RELATED APPLICATIONS

This application claims foreign priority under 35 U.S.C. § 119(a)-(d) to Application No. DE 10 2014 012 882.2 filed on Sep. 4, 2014, the entire contents of which are hereby incorporated by reference.

FIELD OF THE INVENTION

The invention relates to a device for cleaning and/or inspection of a flow channel, in particular a sewage channel, with a purge hose that can be introduced into the channel and charged with high pressure purge water. The purge hose is connected with its front end to at least one channel nozzle provided with jet nozzles creating a recoil effect. The at least one channel nozzle is controllable by rotation around its axis.

BACKGROUND

An arrangement of this type is known for example from DE 10 2011 120 152 A1. For rotation of the channel nozzle the purge hose supporting it is twisted as a whole. For this purpose, in the known arrangement a hose holding device formed as a coiler provided for holding a purge hose supply is rotated around an axis parallel to the longitudinal axis of the purge hose phasing out. For this purpose, the coiler is fixed to the rear of a carrier vehicle by means of a pivot joint and twistable by means of a driving mechanism. All supply lines allocated to the coiler as well as the purge water line must be lead centrically through the pivot joint. This proves to be very complex and susceptible to errors. Another disadvantage of the known arrangement is that for carrying out a rotation of the channel nozzle, the purge hose supporting it must be rotated as a whole over its entire length which has an unfavorable effect on the achievable precision. In this connection one has to assume that the purge hose charged with high pressure purge water presents a small but not entirely negligible torsion spring property so that a certain twisting occurs during rotation of the purge hose with increasing length which makes a precise rotation of the channel nozzle difficult, and which therefore can lead to errors regarding the angle of rotation. Thus, the known arrangement turns out to be not simple, trouble-free and precise enough.

DE 20 2012 011 773 U1 shows a purge hose with sections connected with each other via coupling. The coupling contains a housing element and an engagement element engaging into the housing element with the engagement element being formed as a hollow sphere element to which a supporting spherical cap is attributed provided on the housing in order to permit mutual movability of the two purge hose sections around movement axes extending transverse to the flow axis. In direction of rotation around the purge hose axis the two elements of the coupling unit are locked against each other. A rotation around the purge hose axis is therefore transmitted from the rear hose section to the front hose section. Also in this known arrangement, for rotation of the channel nozzle the purge hose must therefore be twisted as a whole which leads to the disadvantages regarding construction, precision and susceptibility to failure already mentioned above.

On this basis, it is an objective of the present invention to improve a device of the type mentioned above with simple and cost-effective means such that not only a simple and cost-effective construction is achieved but also a precise mode of operation with a low rate of failure is guaranteed.

SUMMARY

This objective is achieved according to an aspect of the invention by the fact that the purge hose is subdivided into at least two sections which are connected with each other by a coupling unit through which high pressure purge water can flow, which comprises a housing element connected to a purge hose section and a hollow piston element arranged in the housing element in an axially movable manner and connected to the other purge hose section, with the housing element and the hollow piston element being supported to each other by a spring and cooperating via a converter converting an axial movement into a rotation.

By these measures, the disadvantages of the State of the Art mentioned above can be entirely avoided. By the pressure of the high pressure purge water the purge hose is not only stressed in radial direction but also in axial direction. By means of this longitudinal force the two elements of the coupling unit are shifted against each other in axial direction with the axial movement by means of the converter being converted into a rotation. Therefore, it is possible in an advantageous manner to accomplish a rotation of the purge hose section supporting the channel nozzle relative to the rear purge hose section by modification of the pressure of the high pressure spray water. A rotation of the entire purge hose including the purge hose holding device etc. is here advantageously not necessary. Therefore, the purge hose holding device can advantageously be arranged in a stationary manner which strongly simplifies the construction and prevents susceptibility to errors. Another special advantage of the measures according to an aspect of the invention is also that the inventive coupling unit can be retrofitted easily and without greater expenditure so that already existing arrangements for cleaning and inspection of flow channels can be equipped with the device according to an aspect of the invention for rotation of the front purge hose section and the channel nozzle fitted to it which extends their possibilities of application and thus in total results in a good economic efficiency.

Hence it can be provided in an expedient way that the hollow piston element comprises a head circumferentially cooperating with the housing element and a neck graduated against it which passes through an allocated housing opening opposite to the purge hose connection on the housing side, and is connected with its external end, facing away from the head, with the attributed purge hose section. Here, a manifest connection of the coupling unit to the ends facing towards each other of the two purge hose sections results. Moreover, due to the graduation of the hollow piston element, an annulum results advantageously within the housing element in which annulum the spring can be placed. Said spring can therefore be expediently formed as a helical compression spring comprising the inner area of the neck of the hollow piston element and passed there through which can have an advantageous effect on operational safety.

Another advantageous measure can be that the converter is formed as a connecting link comprising on the one hand a helical groove and on the other hand a sliding element engaging into the helical groove. By it, also larger angles of rotation can be advantageously accomplished.

A particularly preferable embodiment of the above mentioned measures can be that the housing element is provided with an internal thread and the hollow piston element is provided with an external thread engaged with it. This measure does not only yield a cost-effective producibility but advantageously also results in a reliable mutual engagement and thus a reliable transmission of force.

In another example embodiment of the superior measures it can be provided that the coupling unit is arranged in front of the channel nozzle with a comparably small distance of preferably 1-3 meters. By this it is ensured that on the one hand movability of the channel nozzle is not restricted by the coupling unit and that on the other hand no considerable twisting of the purge hose section leading from the coupling unit up to the channel nozzle occurs.

BRIEF DESCRIPTION OF THE DRAWINGS

Example embodiments will now be described with reference to the accompanying drawings.

DETAILED DESCRIPTION

Figure 1:
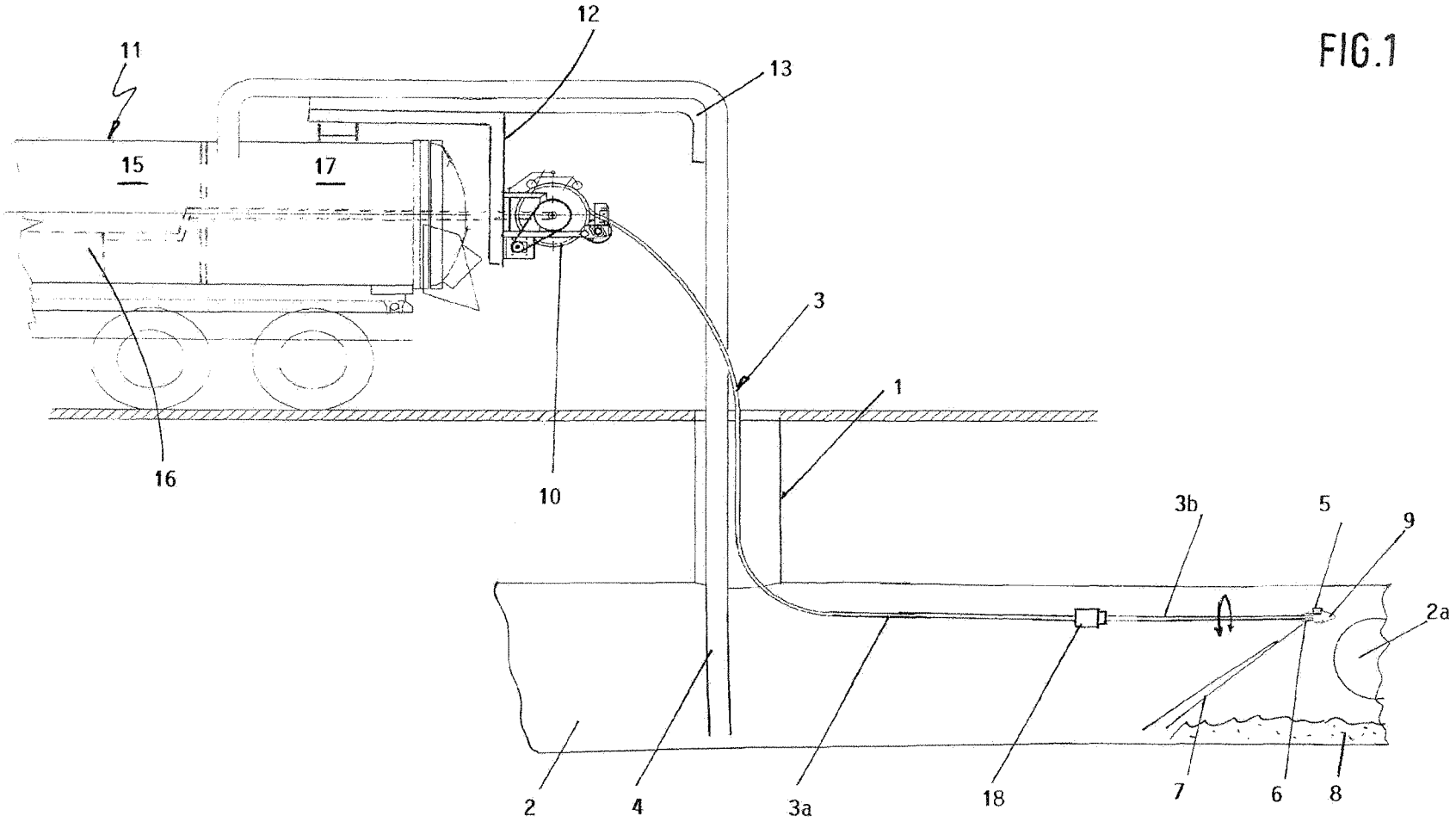
FIG. 1 is a schematic diagram of a device for channel cleaning and/or inspection according to an example embodiment of the present invention.

FIG. 1 shows a section of a sewage channel system with a channel 2 accessible via a shaft 1 into which a purge hose 3 charged with high pressure purge water and a suction hose 4 charged with suction draught are introduced. The purge hose 3 supports at its front end a channel nozzle 6 provided with jet nozzles 5. Jet nozzles 5 are directed towards the front and towards the rear and can be provided such that a high pressure water jet 7 exits each of the jet nozzles 5 in operation. The pressure of the high pressure purge water is in the range from 100 to 150 bar.

A jet directed towards the front serves for loosening up of dirt accumulations 8. The jets 7 exiting rearwards achieve a further loosening up of the dirt accumulations 8 as well as a jet force of the channel nozzle 6 and a flotation of the loosened up dirt towards the end of the suction hose 4 lowered up to the sole of the channel 2. For carrying out a channel inspection, the channel nozzle 6 can be provided with a lighting and camera device 9. A jet exiting towards the front can also be waived.

The rearward jet nozzles 5 are arranged expediently with respect to the nozzle axis in such an asymmetrical way that in addition to the propulsion force a force directed upwards and acting on the channel nozzle 6 is created so that the channel nozzle 6 is in a desired distance from the channel sole.

The purge hose 3 is drawn into the channel 2 by the channel nozzle 6 mounted on its front end and pushed forward by the recoil effect of the jets 7. At the same time, the purge hose 3 is removed from a hose holding device 10 receiving a hose supply. This is formed as a coiler which is mounted on a carrier vehicle, in the example embodiment shown in FIG. 1 the form of a sewer cleaning vehicle 11. This is provided with a rotatable cantilever 12 in the example shown which carries the hose holding device 10.

A receiving device (not shown in more detail) receiving the hose supply, for example, in the form of a horizontal coiler etc. can likewise be attributed to the suction hose 4 which can be lowered with its front, open end up to the channel sole. The suction hose 4 can be lowered into the channel drains into the channel via a nozzle 13 of the cantilever 12.

The carrier vehicle, here in the form of a sewer cleaning vehicle 11, contains a purge water tank 15 to which a high pressure pump 16 supplying the purge hose 3 with high pressure purge water is connected on the suction side, which can generate a water pressure of 100-150 bar. The purge water tank 15, in the example embodiment, is separated from an advantageously evacuable sludge tank 17 into which the suction hose 4 leads with its upper end over which the water-dirt mixture sucked off the channel 2 is thrown into the sludge tank 17.

During operation it happens that the channel nozzle 6 must be rotated around its axis in order to sever, for example, a tree root grown into the channel 2, or in order to direct the channel nozzle 6 into a lateral channel branch 2*a*, for example in the form of a house connection etc. For this purpose, the channel nozzle 6 is rotated around its axis in such a way that the jets 7 are directed rearwards and are exiting the jet nozzles 5 arranged asymmetrically to the nozzle. This results in a lateral force by which the channel nozzle 6 is directed into the lateral channel branch 2*a*. Rotation of the channel nozzle 6 occurs by means of rotation of the purge hose 3 supporting the channel nozzle 6. But in order not to have to rotate the entire purge hose 3, the purge hose 3 is subdivided into two sections 3*a*, 3*b*, which are connected with each other by a coupling unit 18 through which purge water can flow, by means of which a rotation of the front section 3*a* supporting the channel nozzle 6 can be achieved subject to the pressure of the high pressure purge water flowing through the purge hose 3.

Figure 2:
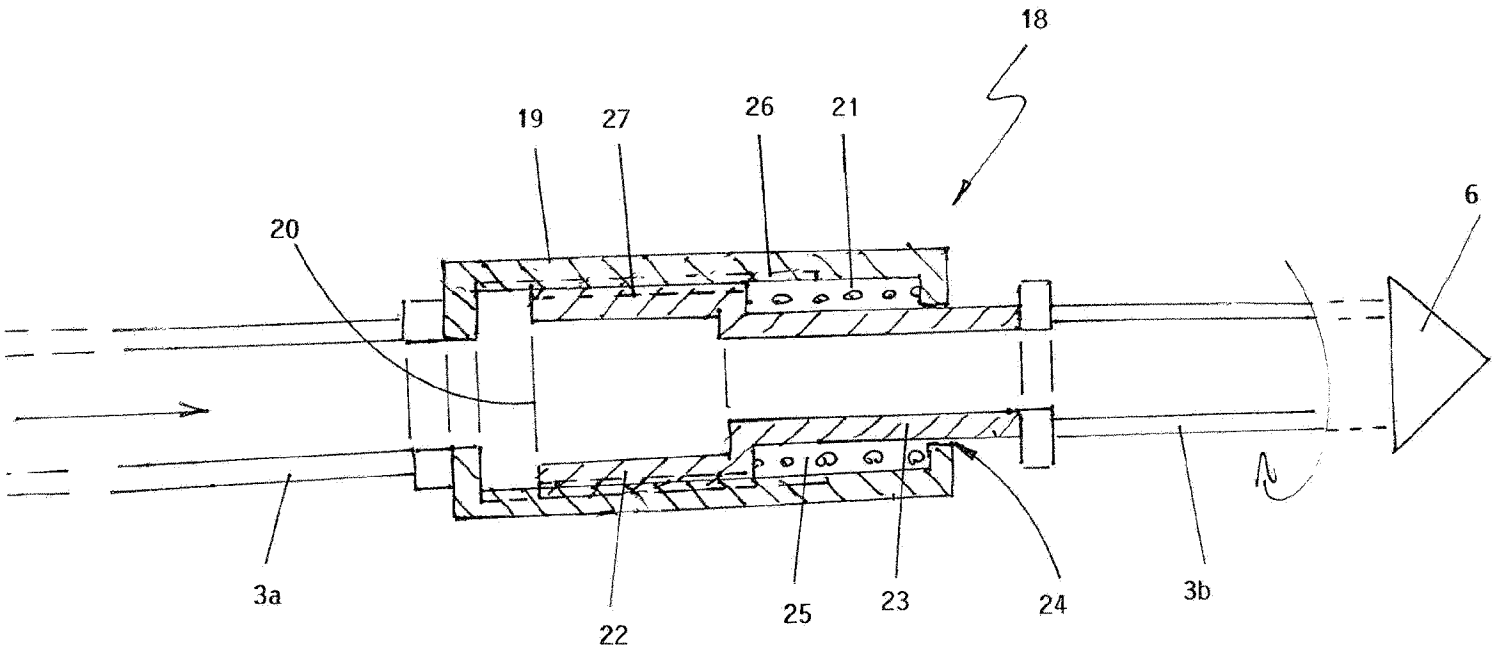
FIG. 2 is an enlarged schematic diagram of the coupling unit connecting the sections of the subdivided purge hose with each other of the device in FIG. 1 according to an example embodiment of the present invention.

As shown in FIG. 2, coupling unit 18 includes a housing element 19 connected to a hose section, to the rearward hose section 3*a* coming from the hose holding device 10, and a hollow piston element 20 movable in the housing element in axial direction, and connected to the other section of the purge hose 3, the hose section 3*b* leading to the channel nozzle 6, which hollow piston element 20 cooperates with the housing element 19 via a converter converting an axial movement and is supported to it by a spring 21.

The hollow piston element 20 includes a piston head 22 circumferentially cooperating with the inner circumference of a bore of the housing element 19 and a neck 23 graduated against piston head 22. The neck 23 passes through an housing opening 24 on the front opposite to the purge hose connection on the housing side, and the neck 23 is connected with its external end to the end facing rearward of the purge hose section 3*b* leading to the channel nozzle 6. The graduation between the piston head 22 and the neck 23 results in an annulus 25 or annular gap within the housing element 19 in which the spring 21 can be placed. The spring 21 can simply be formed as a helical compression spring surrounding the neck 23 and counteracting the water pressure. On the one hand, the spring 21 is supported by the graduation of the hollow piston element 20. On the other hand, the spring 21 is supported by a closure of the housing element 19, for example, by a lid etc., through which the neck 23 passes.

The converter mentioned above for conversion of an axial movement into a rotation is expediently formed as a connecting link comprising on the one hand a provided helical groove and on the other hand a provided sliding element engaging into the helical groove. By it, also larger angles of rotation can be advantageously accomplished. In the example shown, the connecting link is formed as a threaded connection. For this purpose, the housing element 19 is provided with an internal thread 26 extended at least over a part of the length of its inner space and the hollow piston element 20 is provided with an external thread 27 engaged with it and allocated to the piston head. Accordingly, the thread groove of the internal thread 26 on the housing side acts as a helical groove and the thread web of the external thread 27 on the piston side acts as a sliding element engaged in it. The pitch of the helical groove and/or the thread pitch are outside of the self-locking range so that an axial displacement of the hollow piston element 20 automatically leads to a rotation of the hollow piston element 20.

During operation, as a result of the pressure applied on the rear side of the hollow piston element 20 through which high pressure purge water flows, a force is created that is directed forward in flow direction acting on the hollow piston element 20, through which the hollow piston element 20 contrary to the effect of the spring 21 is shifted forward, i.e. in flow direction of the high pressure purge water which flows through the hollow piston element 20, with the axial movement as a result of the connecting link formed by the internal thread 26 and the external thread 27 being converted simultaneously into a rotation of the hollow piston element 20 and hence the front purge hose section 3*b* attached to it and the channel nozzle 6 attached to it in turn. When the pressure of the high pressure purge water increases, a forward movement with corresponding rotation of the hollow piston element 20 is achieved with the spring 21 counteracting the water pressure being compressed. When the pressure of the high pressure purge water decreases, the hollow piston element 20 is returned by the spring 21 with the axial return movement of the hollow piston element being converted into an opposite rotation. By modification of the pressure of the high pressure purge water accordingly a rotation of the hollow piston element in any desired direction of rotation and thus of the channel nozzle 6 connected with it over the purge hose section 3*b* is possible.

In order to accomplish this, a device for modification of the pressure of the high pressure purge water expediently allocated to the high pressure pump 16 as well as a display device for displaying the currently acting pressure is provided. A pressure change can simply be accomplished by modification of the speed of the high pressure pump 16. The display device can be formed as a manometer which can here expediently be provided with a scale for the angle of rotation.

For deflection of the channel nozzle 6 by 90° a rotation by 90° is sufficient. For a deflection to the left or to the right therefore an angle of rotation range of approx. 180° is sufficient. As possibly several consecutive pipe branches may occur, a slightly larger angle of rotation range than 180° is provided. An angle of rotation of 360°-450° is sufficient for most cases.

Subdivision of the purge hose 3 into the two sections 3*a* and 3*b* can generally occur anywhere in the area of the entire purge hose length. Also a multiple subdivision of the purge hose 3 would be possible. Expediently, said subdivision and thus positioning of the coupling unit 18 occurs in an area close to the channel nozzle 6 so that the front hose section 3*b* is much shorter than the rear hose section 3*a*. The length of the hose section 3*b* and accordingly the distance of the channel nozzle 6 from the coupling unit 18 on the one hand is supposed to be large enough in order to guarantee sufficient movability of the channel nozzle 6 independent of the coupling unit 18, and on the other hand small enough in order to be able to neglect twisting in the area of the hose section 3*b*. A length of the front hose section 3*b* and accordingly a length of the distance between channel nozzle 6 and coupling unit 18 in the area of approx. 1-3 m fulfills the requirements mentioned above.

In the case of multiple subdivision of the purge hose 3, several consecutive coupling units are provided, which carry out the same rotations in each case, the angles of rotation of which add up so that already comparatively small pressure changes are sufficient. In addition or alternatively to the camera device 9 of the channel nozzle 6, the coupling unit 18 adjacent to it can also be provided with such a camera device. In the case of several coupling units 18, a camera device can also be attributed to several ones.

In summary, a device for cleaning and/or inspection of a flow channel, in particular a sewage channel is provided with a purge hose that can be introduced into the channel and charged with high pressure purge water, which purge hose with its front end is connected at least to one channel nozzle provided with jet nozzles creating a recoil effect which channel nozzle is controllable by rotation around its axis, whereby the purge hose is subdivided into at least two sections which are connected with each other by a coupling unit through which high pressure purge water can flow, which comprises a housing element connected to a purge hose section and a hollow piston element arranged in the housing element in an axially movable manner and connected to the other purge hose section, with the housing element and the hollow piston element being supported to each other by a spring and cooperating via a converter converting an axial movement into a rotation.

According to an example embodiment, the rearward hose section coming from a hose holding device is connected to the housing element, and the front purge hose section leading to the channel nozzle is connected to the hollow piston element.

According to another example embodiment, the hollow piston element comprises a head circumferentially cooperating with the housing element and a neck graduated against it which passes through an allocated opening of the housing element opposite to the purge hose connection on the housing side, and is connected with its external end with the attributed purge hose section.

According to a further example embodiment, the spring is formed as a helical compression spring located in the housing element comprising an inner area of the possibly existing neck of the hollow piston element.

According to yet another example embodiment, the converters formed as a connecting link comprising on the one hand a provided helical groove and on the other hand a provided sliding element engaging into the helical groove.

According to an example embodiment, the connecting link is formed as a threaded connection and that the housing element for this purpose is provided with an internal thread and the hollow piston element is provided with an external thread engaged with it.

According to yet another example embodiment, the pitch of the helical groove and/or the sliding element attributed to it is located outside the self-locking range.

According to a further example embodiment, the coupling unit is arranged in front of the channel nozzle with a comparatively small distance in the range of 1-3 m.

According to another example embodiment, means for change of the pressure of the high pressure purge water attributed to the purge hose is provided.

According to yet another example embodiment, a lighting and/or printing device is attributed to the channel nozzle.

What is claimed is:

1. A device for cleaning and/or inspecting a flow channel, the device comprising:

a purge hose introduced into the flow channel and charged with high-pressure purge water, the purge hose being connected at a front end to at least one channel nozzle provided with jet nozzles creating a recoil effect, the at least one channel nozzle being controllable by rotation around its axis, the purge hose being subdivided into at least two purge hose sections which are connected with each other by a coupling unit through which the high-pressure purge water flows;

the coupling unit comprising:

a housing element connected to a first purge hose section and including a helical groove arranged on an inner surface thereof and extending in a radial direction; and a hollow piston element arranged in the housing element in an axially movable manner, connected to a second purge hose section, and including a sliding element arranged on an outer surface thereof;

the helical groove of the housing element and the sliding element of the hollow piston forming a converter;

the housing element and the hollow piston element being supported by a spring and cooperating via the to convert an axial movement of the hollow piston element into a rotation of the hollow piston element, wherein the spring is configured to counteract a force generated by the high-pressure purge water acting on the hollow piston element, wherein the hollow piston element is configured to be rotated in a first direction of rotation as the hollow piston element is displaced in the flow direction of the high-pressure purge water, and wherein the hollow piston element is configured to be rotated in a second direction of rotation opposite to the first direction of rotation as the hollow piston element is displaced in the direction opposite to the flow direction of the high-pressure purge water.

2. The device according to claim 1, wherein a rearward hose section extending from a hose holding device is connected to the housing element, and wherein a front purge hose section leading to the channel nozzle is connected to the hollow piston element.

3. The device according to claim 1, wherein the hollow piston element comprises:

a head circumferentially cooperating with the housing element; and a neck graduated against the head which passes through an allocated opening of the housing element opposite to a purge hose connection on a housing side, and which is connected at an external end to an attributed purge hose section.

4. The device according to claim 3, wherein:

the spring is a helical compression spring located in the housing element, and the spring surrounds an inner area of the neck of the hollow piston element.

5. The device according to claim 1, wherein the helical groove is an internal thread and the sliding element is an external thread engaging into the internal thread thereby forming a threaded connection.

6. The device according to claim 5, wherein a connecting link is formed as a threaded connection, wherein the housing element is provided with an internal thread, and wherein the hollow piston element is provided with an external thread engaged with the hollow piston element.

7. The device according to claim 5, wherein at least one of the helical groove and the sliding element attributed to the helical groove has a pitch which prevents the converter from self-locking.

8. The device according to claim 1, wherein the coupling unit is arranged in front of the channel nozzle with a comparatively small distance in the range of 1-3 m.

9. The device according to claim 1, further comprising:

a high-pressure pump configured to supply the purge hose with the high-pressure purge water, and a control device configured to control a pressure of the high-pressure purge water supplied to the purge hose by controlling a speed of the high-pressure pump.

10. The device according to claim 1, further comprising at least one of an illuminating device and a camera device arranged at the at least one channel nozzle.

11. The device according to claim 1, wherein the flow channel is a sewage channel.

12. The device according to claim 1, wherein:

the hollow piston element is configured to be axially displaced in a flow direction of the high-pressure purge water by a first force generated by the high-pressure purge water acting on the hollow piston element as a pressure of high-pressure purge water applied on a rear side of the hollow piston element is increased; and the hollow piston element is configured to be axially displaced in a direction opposite to the flow direction of the high-pressure purge water by a second force generated by the spring acting on the hollow piston element as the pressure of high-pressure purge water applied on the rear side of the hollow piston element is decreased.

13. The device according to claim 1, wherein the purge hose and the coupling unit are configured to withstand a water pressure of 100 to 150 bar.

14. The device according to claim 1, wherein the hollow piston element is configured to be axially displaced in a direction opposite to the flow direction of the high-pressure purge water to a starting position when the high-pressure purge water stops flowing.

* * * * *